US007674133B2

(12) United States Patent
Fogg et al.

(10) Patent No.: US 7,674,133 B2
(45) Date of Patent: Mar. 9, 2010

(54) ELECTRICAL CONNECTOR WITH GROUND CONTACT MODULES

(75) Inventors: Michael Warren Fogg, Harrisburg, PA (US); Michael Frank Cina, Elizabethtown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 80 days.

(21) Appl. No.: 12/137,155

(22) Filed: Jun. 11, 2008

(65) Prior Publication Data

US 2009/0311908 A1 Dec. 17, 2009

(51) Int. Cl.
*H01R 13/648* (2006.01)

(52) U.S. Cl. ..... 439/607.07; 439/108

(58) Field of Classification Search ..... 439/607.05–607.11, 108
See application file for complete search history.

(56) References Cited

U.S. PATENT DOCUMENTS 5,795,191 A 8/1998 Preputnick et al.
6,116,926 A * 9/2000 Ortega et al. ..... 439/108
6,146,202 A * 11/2000 Ramey et al. ..... 439/607.1
6,364,710 B1 * 4/2002 Billman et al. ..... 439/607.11
6,386,924 B2 5/2002 Long
6,743,057 B2 6/2004 Davis et al.
6,776,659 B1 * 8/2004 Stokoe et al. ..... 439/607.11
6,923,664 B2 * 8/2005 Ito et al. ..... 439/108
7,131,870 B2 11/2006 Whiteman et al.
7,172,461 B2 2/2007 Davis et al.
7,381,092 B2 * 6/2008 Nakada ..... 439/607.1
2006/0276081 A1 * 12/2006 Cohen et al. ..... 439/608
2007/0155239 A1 * 7/2007 Nakada ..... 439/607
2009/0011645 A1 * 1/2009 Laurx et al. ..... 439/608
2009/0017682 A1 * 1/2009 Amleshi et al. ..... 439/608

* cited by examiner

*Primary Examiner*—Gary F. Paumen

(57) ABSTRACT

A connector assembly includes a housing and a contact module assembly including first and second contact modules loaded into the housing. The first contact module has a plurality of ground leads extending between mating contacts and mounting contacts. The ground leads extend along separate paths within a first plane. The second contact module has a plurality of signal leads extending between mating contacts and mounting contacts. The signal leads extend along separate paths within a second plane. The ground leads are aligned with the signal leads in a direction transverse to the first plane, and the ground leads have a width and a thickness defining a cross-sectional area that is larger than a cross sectional area of the signal leads.

20 Claims, 6 Drawing Sheets

ELECTRICAL CONNECTOR WITH GROUND CONTACT MODULES

BACKGROUND OF THE INVENTION

The subject matter herein relates generally to electrical connectors, and more particularly to electrical connectors having ground contact modules.

It is common, in the electronics industry, to use right angled connectors for electrical connection between two circuit boards or between a circuit board and another electrical component. At least some right angle connectors include a plurality of contact modules that are received in a housing. Each contact module typically includes a plurality of electrical mating contacts on a mating edge of the contact module and a plurality of electrical mounting contacts on a mounting edge of the contact module for electrically connecting the circuit boards or the circuit board and the other electrical component.

Various configurations of connectors are known. For example, some connectors have contact modules that have both signal and ground contact leads extending between the mating contacts and the mounting contacts of the contact modules. Other known connectors have signal contact modules that have only signal leads and ground contact modules that have only ground leads. The leadframes, and thus the leads, of both the signal contact modules and the ground contact modules are formed identically. However, the circuit board(s) and the electrical component only send signals through the leads of the signal contact modules. In these known connectors, the ground contact modules are placed between a pair of the signal contact modules to provide shielding between adjacent pairs of the leads of the signal contact modules. However, due to increases in data transfer speed through the connectors, the connectors have problems with electrical performance, such as crosstalk between adjacent signal pairs of adjacent signal contact modules. There is a need for a connector that provides adequate shielding and/or isolation between signal pairs. There is a need for a connector that may be manufactured at a reasonable cost.

BRIEF DESCRIPTION OF THE INVENTION

In one embodiment, a connector assembly is provided that includes a housing and a contact module assembly including first and second contact modules loaded into the housing. The first contact module has a plurality of ground leads extending between mating contacts and mounting contacts. The ground leads extend along separate paths within a first plane. The second contact module has a plurality of signal leads extending between mating contacts and mounting contacts. The signal leads extend along separate paths within a second plane. The ground leads are aligned with the signal leads in a direction transverse to the first plane, and the ground leads have a width and a thickness defining a cross-sectional area that is larger than a cross sectional area of the signal leads.

Optionally, the ground leads may be wider than the signal leads. A lead axis of the ground leads may be substantially aligned with a lead axis of corresponding signal leads. The paths may be non-linear and extend between mating contacts and mounting contacts that are generally perpendicular to one another. Optionally, the first and second contact modules may each include a dielectric body and a leadframe, wherein the bodies of the first and second contact modules are substantially similarly dimensioned, and wherein the leads of the leadframes of the first and second contact modules are sized differently. Optionally, a third contact module may be loaded into the housing, wherein the third contact module has a plurality of signal leads corresponding to signal leads of the second contact module to define differential signal pairs. The contact module assembly may include a plurality of first contact modules, a plurality of second contact modules and a plurality of third contact modules that are loaded into the housing in a pattern having second and third contact modules arranged adjacent one another and forming signal module pairs, and at least one first contact module arranged between adjacent signal module pairs.

In another embodiment, a contact module assembly is provided including a first contact module having a plurality of ground leads extending between mating contacts and mounting contacts, wherein the ground leads extend along separate paths within a first plane and have a width and a length defined within the first plane. A second contact module is provided adjacent the first contact module and has a plurality of signal leads extending between mating contacts and mounting contacts. The signal leads extend along separate paths within a second plane and have a width and a length defined within the second plane. A third contact module is provided adjacent the second contact module and has a plurality of signal leads extending between mating contacts and mounting contacts. The signal leads extend along separate paths within a third plane and have a width and a length defined within the third plane. The ground leads are aligned with the signal leads of both the second contact module and the third contact module in a direction transverse to the first plane and the ground leads are wider than the signal leads.

In a further embodiment, a connector assembly is provided including a housing and a plurality of signal contact modules arranged as signal module pairs. Each signal contact module includes a body, a radially inner signal lead and a radially outer signal lead separate from the radially inner signal lead. The radially inner signal leads are defined by inner and outer edges and the radially outer signal leads are defined by inner and outer edges. The radially outer signal leads within each signal module pair cooperate to define a first differential pair, and the radially inner signal leads within each signal module pair cooperate to define a second differential pair. A plurality of ground contact modules are arranged within the housing such that the ground contact modules bound opposite sides of the signal contact modules of at least one of the signal module pairs. The ground contact modules include a body, a radially inner ground lead and a radially outer ground lead. The radially inner ground leads is defined by inner and outer edges and the radially outer ground leads is defined by inner and outer edges. The ground leads are wider than the signal leads such that the outer edges of the ground leads are positioned radially outward with respect to the outer edges of the signal leads and such that the inner edges of the ground leads are positioned radially inward with respect to the inner edges of the signal leads.

DETAILED DESCRIPTION OF THE INVENTION

Figure 1:
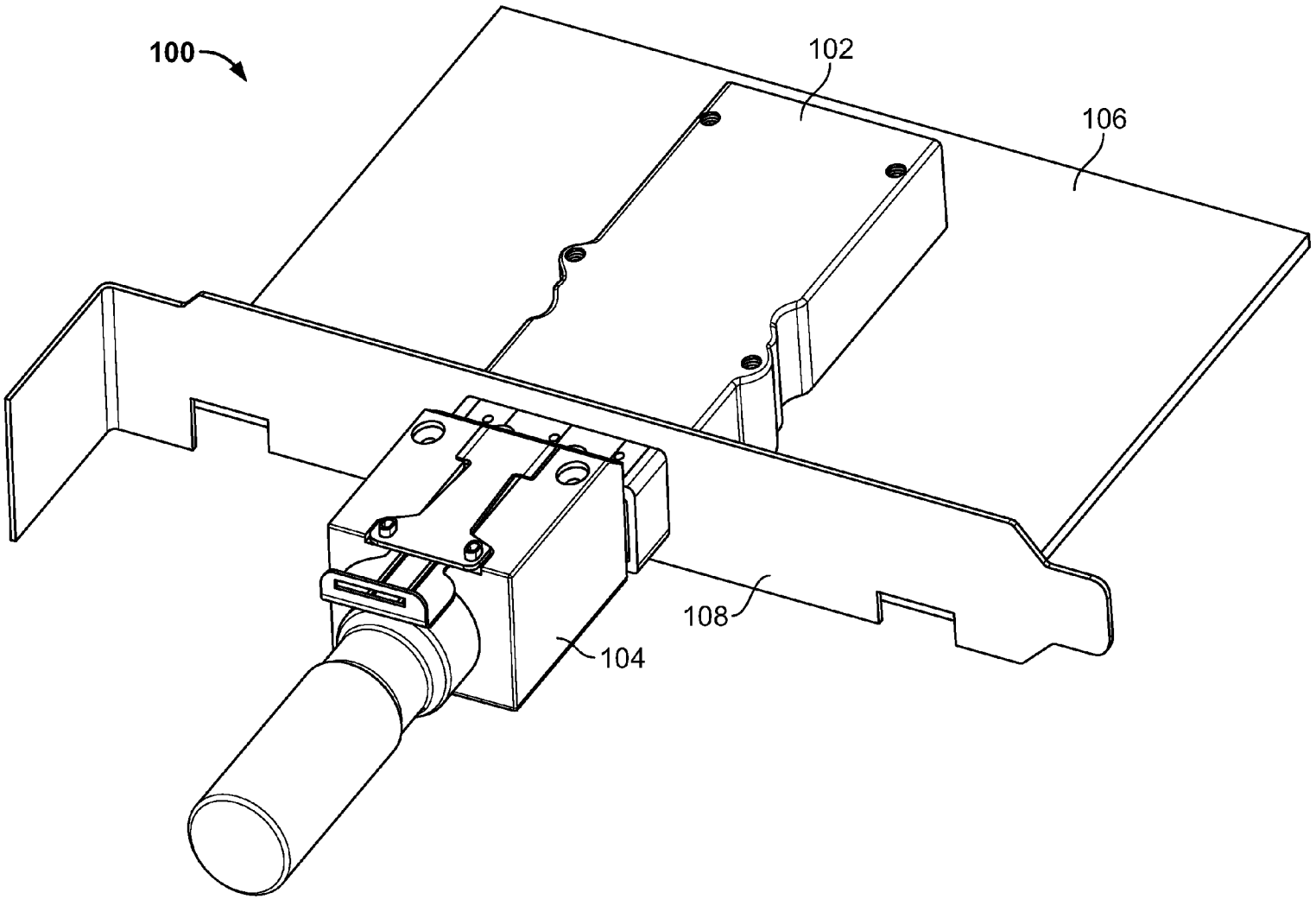
FIG. 1 is a perspective view of a connector system having a receptacle connector assembly and a plug connector assembly.

FIG. 1 is a perspective view of a connector system 100 having a receptacle connector assembly 102 and a plug connector assembly 104. In the illustrated embodiment, the receptacle connector assembly 102 is mounted to a circuit board 106. The receptacle connector assembly 102 may extend through an opening in a panel 108, such as a wall of a housing of a device (not shown) that includes the circuit board 106. In such an example, the receptacle connector assembly 102 enables one or more plug connector assembly 104 located outside the housing to be electrically connected to the circuit board 106 contained within the housing. In the illustrated embodiment, the receptacle connector assembly 102 receives a Small Form Factor Pluggable (SFP) module. However, it is to be understood that the benefits and advantages of embodiments of the receptacle connector assembly described herein may accrue equally to other types of electrical assemblies across a variety of systems and Standards. For example, the receptacle connector assembly 102 may receive another type of connector, such as an XFP transceiver module, a Quad Small Form-factor Pluggable (QSFP), or the like.

The plug connector assembly 104 may be a pluggable electrical component such as a Small Form Factor Pluggable (SFP) transceiver module, an XFP transceiver module, a Quad Small Form-factor Pluggable (QSFP), or the like. The plug connector assembly 104 may be cable mounted or board mounted. Although the receptacle connector assembly 102 is shown as being able to receive one plug connector assembly 104, the receptacle connector assembly 102 may be configured to receive two or more plug connector assembly 104. For example, the receptacle connector assembly 102 may have multiple openings that are configured to receive two or more plug connector assemblies 104 that are laterally adjacent to each other (i.e., side-by-side) and/or two or more plug connector assemblies 104 that are stacked upon each other.

Figure 2:
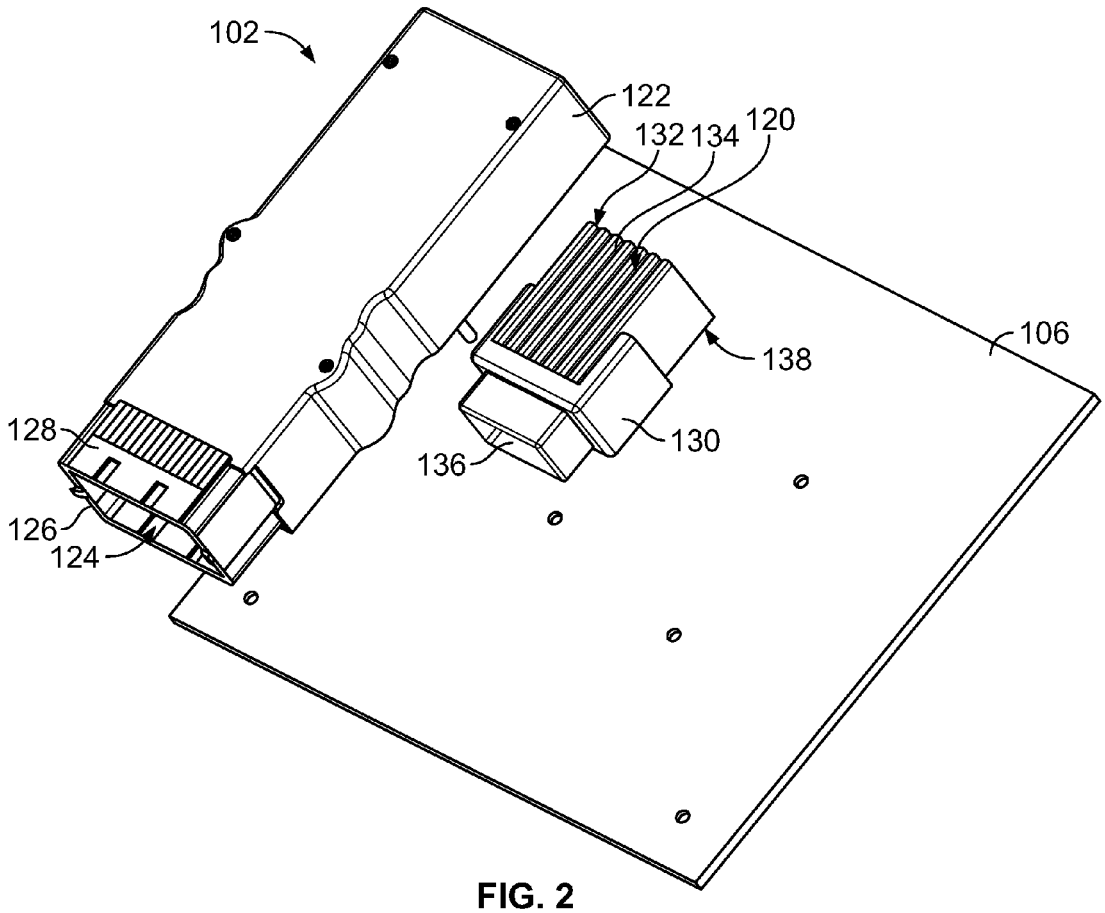
FIG. 2 is an exploded view of the receptacle connector assembly mountable to a circuit board.

FIG. 2 is an exploded view of the receptacle connector assembly 102 mountable to the circuit board 106. The receptacle connector assembly 102 includes a receptacle connector 120 and a cage or cover 122 that is mounted over the receptacle connector 120. The cage 122 includes an opening 124 at a mating end 126 thereof. The opening 124 is configured to receive the plug connector assembly 104 (shown in FIG. 1). Optionally, a shield element 128, such as an EMI gasket, may be provided at the mating end 126.

The receptacle connector 120 includes a housing 130 and a contact module assembly 132 including a plurality of individual contact modules 134 that are loaded into the housing 130. The receptacle connector 120 includes a mating end 136 and a mounting end 138 for mounting to the circuit board 106. The mating end 136 is configured to receive a complementary mating end of the plug connector assembly 104. In an exemplary embodiment, the mating end 136 and the mounting end 138 are at right angles to one another, such that the receptacle connector 120 defines a right angle connector.

Figure 3:
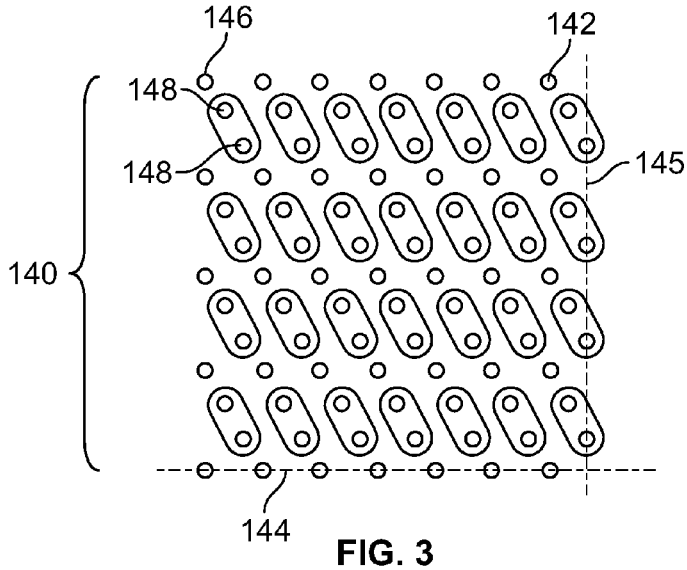
FIG. 3 schematically illustrates a pin pattern in the circuit board for mounting the receptacle connector assembly to the circuit board.

FIG. 3 schematically illustrates a pin pattern 140 in the circuit board 106 (shown in FIG. 2) for mounting the receptacle connector assembly 102 (shown in FIG. 2) to the circuit board 106. A plurality of vias 142 in the circuit board 106 define the pin pattern 140 and are configured to receive contacts of the receptacle connector 120 (shown in FIG. 2). In the illustrated embodiment, the vias 142 are arranged in rows 144 and columns 145. Each column 145 receives each of the contacts from a corresponding one of the contact modules 134 (shown in FIG. 2). FIG. 3 illustrates thirteen rows 144 and twenty-one columns 145, however, any number of rows 144 and columns 145 may be provided, depending on the number of contacts and contact modules 134. Thus, the pin pattern 140 illustrated in FIG. 3 is merely illustrative of one embodiment.

In an exemplary embodiment, a sub-set of the vias 142 define ground vias 146 that are configured to receive ground contacts. Another sub-set of the vias 142 define signal vias 148 that are configured to receive signal contacts. Optionally, the signal vias 148 may be arranged in pairs, schematically represented in FIG. 3.

Figure 4:
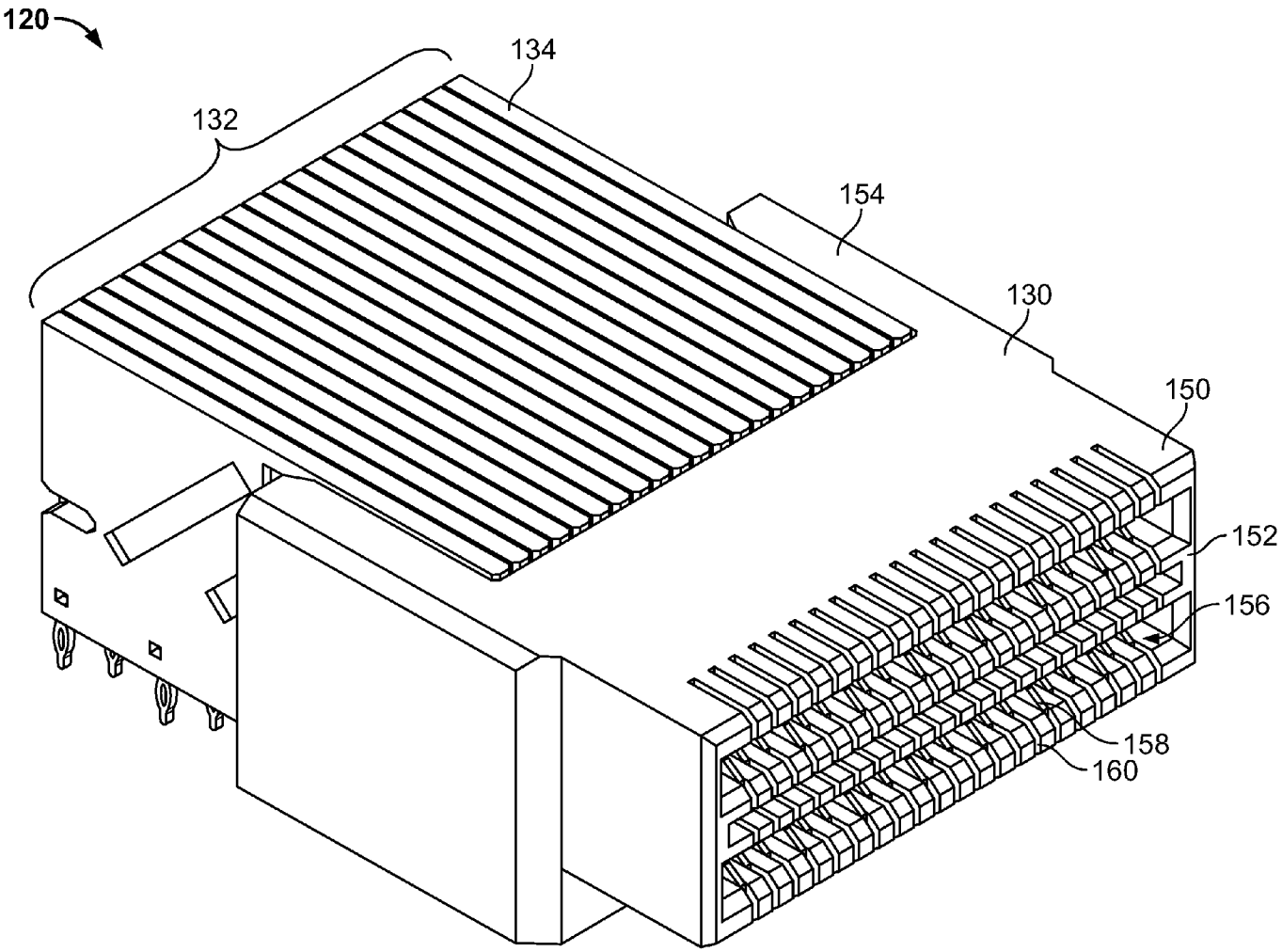
FIG. 4 is a front perspective view of the receptacle connector assembly.

FIG. 4 is a front perspective view of the receptacle connector 120, illustrating the housing 130 and contact module assembly 132. The housing 130 has a forward end portion 150 that includes a mating face 152. The housing 130 also includes a rearwardly extending hood 154. In an exemplary embodiment, the housing 130 is fabricated from a dielectric material, such as a plastic material.

The mating face 152 includes at least one mating channel 156, and in the illustrated embodiment two mating channels 156, that receives a mating portion of the plug connector assembly 104 (shown in FIG. 1). For example, the plug connector assembly 104 may include a pair of circuit boards, or other components, having contact pads on both sides of the circuit boards for mating with the receptacle connector 120 by loading the circuit boards into the mating channels 156. As will be described in further detail below, mating contacts 158 of the contact modules 134 are presented within contact slots 160 of the housing 130. The mating contacts 158 extend at least partially into, or are otherwise exposed at, the mating channels 156 for mating engagement with the circuit boards of the plug connector assembly 104.

Figure 5:
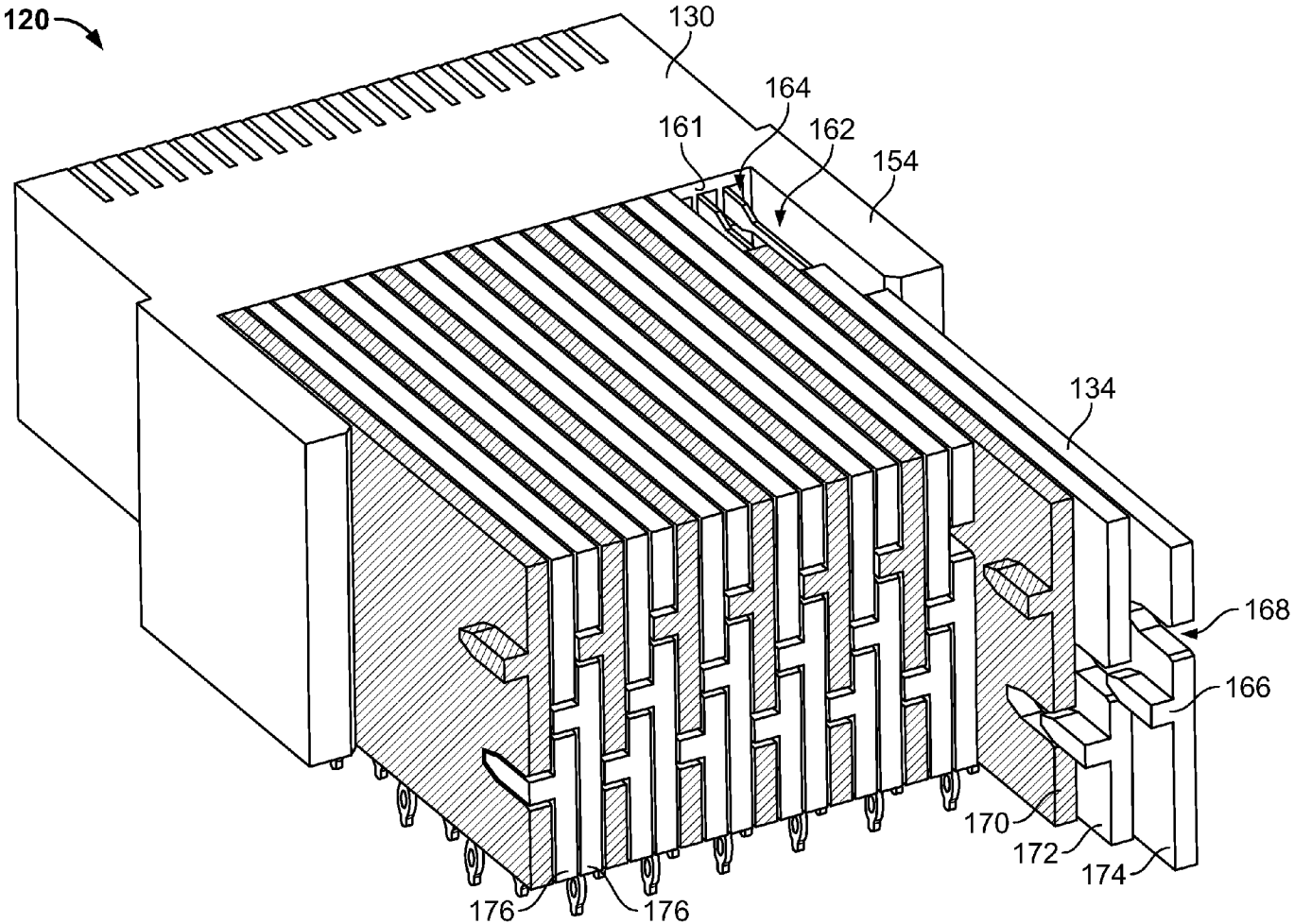
FIG. 5 is a rear perspective view of the receptacle connector assembly, with a plurality of contact modules being loaded into a housing.

FIG. 5 is a rear perspective view of the receptacle connector 120, with a plurality of the contact modules 134 being loaded into the housing 130. The individual contact modules 134 of the contact module assembly 132 are received in the housing 130 from a rearward end portion 161 of the housing 130. Specifically, the hood 154 defines a chamber 162. The chamber 162 receives each of the contact modules 134. The mating contacts 158 of each of the contact modules 134 are loaded into openings 164 in the rearward end portion 161 of the housing 130. In an exemplary embodiment, the contact modules 134 are interlocked with one another to facilitate stabilizing and securing the contact modules 134 within the housing 130. For example, each contact module 134 may include a tab 166 projecting from one side thereof and a slot 168. The tab 166 is configured to be aligned with, and received within, a slot in an adjacent contact module 134. The tabs 166 and slots 168 may provide keying and/or stabilization.

In an exemplary embodiment, the contact modules 134 represent one of a first, or ground, contact module 170, which is illustrated in FIG. 5 as shaded; a second, or signal, contact module 172; or a third, or signal, contact module 174. The ground contact modules 170 include only ground contacts and/or leads and the signal contact modules 172, 174 only include signal contacts and/or leads, as will be described in further detail below. The contact modules 134 are arranged in a predetermined pattern. For example, in the illustrated embodiment, the contact modules 134 are arranged such that two different types of signal contact modules 172 and 174 are positioned adjacent one another to define a signal module pair 176. Each signal module pair 176 is separated by a ground contact module 170. Such a pattern is illustrative and other patterns may be provided in alternative embodiments. For example, the receptacle connector 120 may not include any ground contact modules 170 or more than one ground contact module 170 may be provided between signal module pairs 176. Alternatively, a ground contact module 170 may be provided between each signal contact module 172 or 174. Optionally, more or less than two types of signal contact modules 172 and 174 may be provided. Additionally, different types of contact modules 134 may be provided in alternative embodiments, such as power contact modules.

Figure 6:
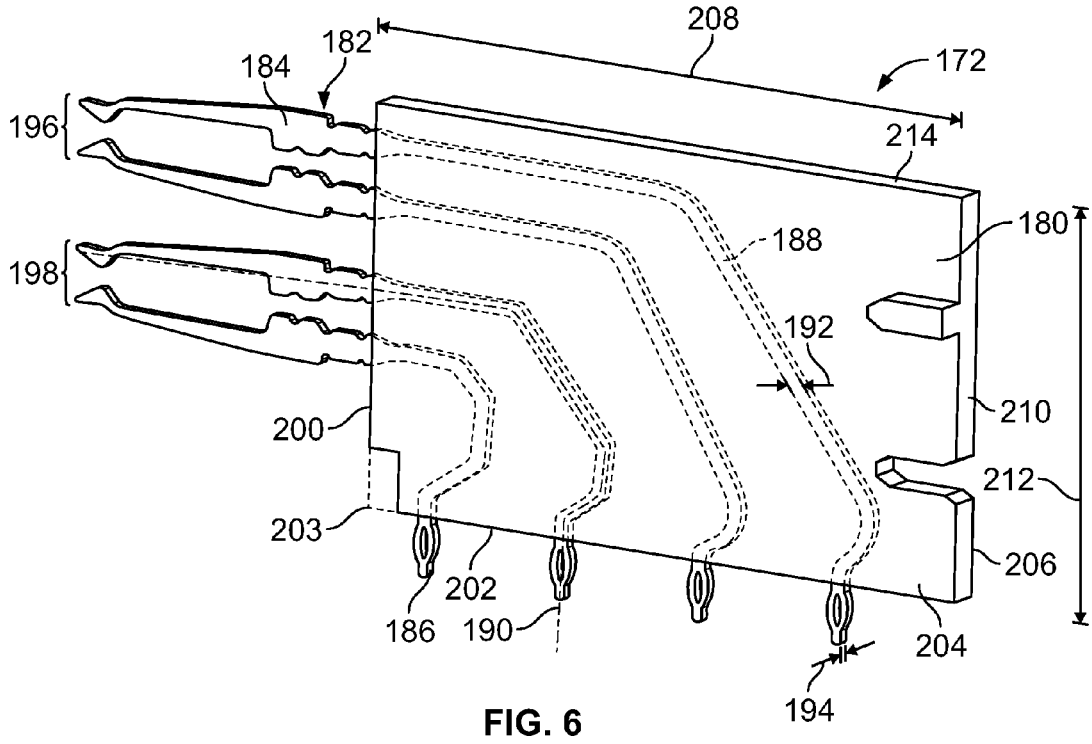
FIG. 6 illustrates a signal contact module for use with the receptacle connector assembly.

FIG. 6 illustrates one of the contact modules 134 for use with the receptacle connector 120. The contact module 134 illustrated in FIG. 6 is a signal contact module 172. However, the other signal contact modules 174 (shown in FIG. 5) and the ground contact modules (shown in FIG. 5) are substantially similar to the signal contact module 172 illustrated in FIG. 6. At least some of the differences are discussed below.

The signal contact module 172 includes a generally planar dielectric body 180 that substantially encases a leadframe 182. The leadframe 182 includes a plurality of mating contacts 184, a plurality of mounting contacts 186 and a plurality of leads 188 that electrically interconnect the mating and mounting contacts 184, 186. In the illustrated embodiment, the mating and mounting contacts 184, 186 are generally perpendicular to one another. Optionally, the leads 188 and corresponding contacts 184, 186 are co-planar along a signal lead plane. In an exemplary embodiment, the leads 188 are integrally formed with the mating and mounting contacts 184, 186. Prior to overmolding the lead frame 182 to form the contact module 172, the leads 188 may be stabilized by a carrier strip, and then removed therefrom by a removal process, such as stamping. The leads 188 are illustrated in FIG. 6 in phantom and extend along separate paths between corresponding mating and mounting contacts 184, 186. The paths illustrated in FIG. 6 are illustrative. For example, the leads 188 follow paths that are generally evenly spaced apart and have transitions that angle the path in different directions. Alternatively, the leads 188 may extend along a generally arcuate or curved path between the mating and mounting contacts 184, 186. Additionally, the paths may be non-evenly spaced apart from one another.

The leads 188 generally extend along a lead axis 190 that defines the path. The leads 188 have a lead length that is defined along the lead axis 190 between the mating and mounting contacts 184, 186. The leads 188 also have a width 192 that is defined transverse to the lead axis 190 and the length. The leads 188 have a thickness 194 that is defined transverse to the length and the width 192. A cross-section of each lead is defined by the width 192 and the thickness 194. Once overmolded, the leadframe 182 fills a predetermined volume of the body 180, which is determined based on the number of leads 188, as well as the length, width 192 and thickness 194 of the leads 188.

While four leads 188 and corresponding mating and mounting contacts 184, 186 are illustrated in FIG. 6, it is realized that the contact module 172 may have any number of leads 188 and corresponding contacts 184, 186. Additionally, any number of the leads 188 may be selected as signal leads, ground leads, or power leads according the desired wiring pattern of the contact module 172.

In an exemplary embodiment, the mating contacts 184 are arranged in two units, an upper unit 196 and a lower unit 198. The mating contacts 184 of the upper unit 196 are complementary and are arranged to mate with opposing sides of a circuit board that is plugged therebetween, such as when the plug connector assembly 104 (shown in FIG. 1) is mated with the receptacle connector assembly 102 (shown in FIG. 1). Similarly, the mating contacts 184 of the lower unit 198 are complementary and are arranged to mate with opposing sides of a circuit board that is plugged therebetween. In alternative embodiments, the mating contacts 184 may not be arranged in units and may be configured to mate with contacts in a different manner. In the illustrated embodiment, the mounting contacts 186 define compliant pins, such as eye-of-the-needle contacts. However, other types of contacts may be used.

The body 180 includes a mating edge 200 and a mounting edge 202. The mating contacts 184 extend from the mating edge 200, and the mounting contacts 186 extend from the mounting edge 202. The mating and mounting edges 200, 202 intersect with one another at an imaginary corner, designated in FIG. 6 by the point 203. Each of the leads 188 are positioned progressively further radially outward from each other with respect to the corner 203.

The body 180 includes opposite sides 204, 206 that extend substantially parallel to and along the lead frame 182. When the contact module 172 is held by the housing 130 (shown in FIG. 5), the sides 204, 206 may each face another corresponding contact module 134 that is held by the housing 130 adjacent the contact module 172. The body 180 extends a length 208 between the mating edge 200 and a rear edge 210, and extends a length 212 between an outer edge 214 and the mounting edge 202. In some embodiments, the body 180 is manufactured using an over-molding process. During the molding process, a portion of each of the leads 188 is encased in a material that forms the body 180. Pinch points and/or slots may be formed in the sides of the body 180 which expose the leads 188. In an exemplary embodiment, the mating and mounting edges 200, 202 extend substantially perpendicular to each other. However, the mating and mounting edges 200, 202 may extend any direction relative to each other, such as, but not limited to, substantially parallel.

Figure 7:
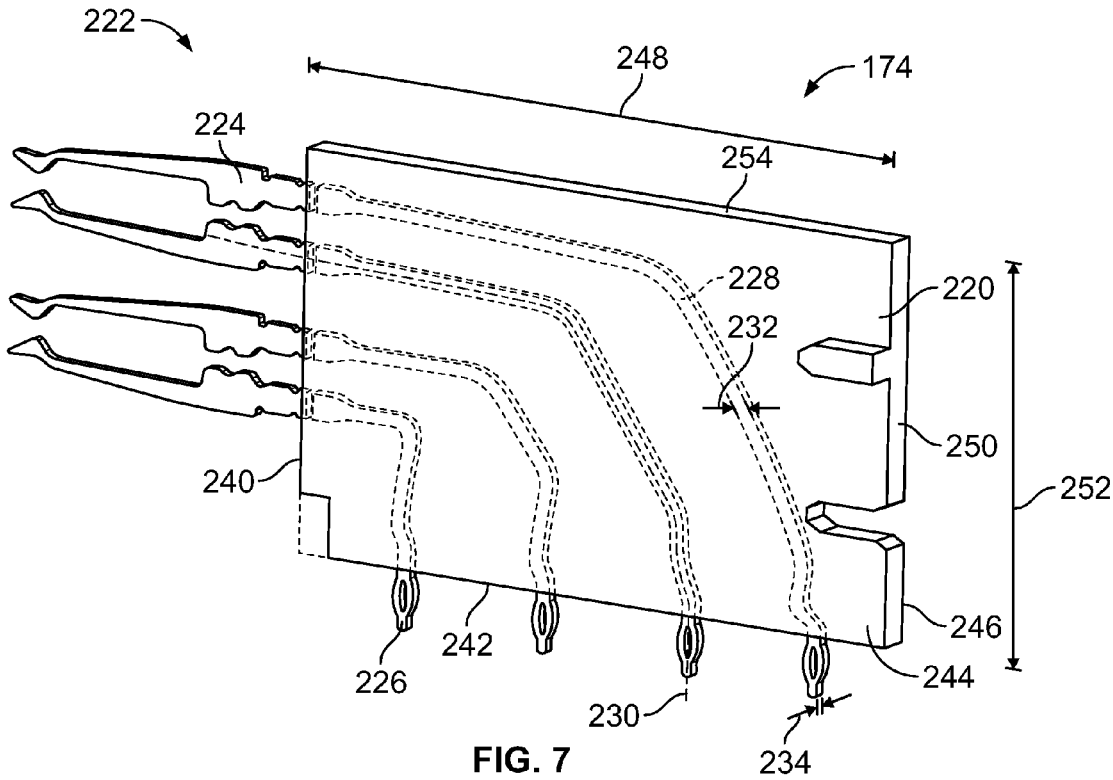
FIG. 7 illustrates another signal contact module for use with the receptacle connector assembly.

FIG. 7 illustrates another signal contact module 174 of the second type, as opposed to the first type illustrated in FIG. 6. In an exemplary embodiment, the signal contact 174 is utilized with one of the other signal contact modules 172 as a signal module pair. The signal contact module 174 includes a generally planar dielectric body 220 that substantially encases a leadframe 222. The leadframe 222 includes a plurality of mating contacts 224, a plurality of mounting contacts 226 and a plurality of leads 228 that electrically interconnect the mating and mounting contacts 224, 226. Optionally, the signal leads 228 may cooperate with corresponding signal leads 186 of the other signal contact module 172 as a differential pair carrying differential signals. The leads 228 are illustrated in FIG. 7 in phantom and extend along separate paths between corresponding mating and mounting contacts 224, 226. The leads 228 generally extend along a lead axis 230 that defines the path. The leads 228 have a lead length that is defined along the lead axis 230 between the mating and mounting contacts 224, 226. The leads 228 also have a width 232 that is defined transverse to the lead axis 230 and the length. The leads 228 have a thickness 234 that is defined transverse to the length and the width 232.

The body 220 includes a mating edge 240 and a mounting edge 242. The mating contacts 224 extend from the mating edge 240, and the mounting contacts 226 extend from the mounting edge 242. The body 220 includes opposite sides 244, 246 that extend substantially parallel to and along the lead frame 222. When the contact module 174 is held by the housing 130 (shown in FIG. 5), the sides 244, 246 may each face another corresponding contact module 134 that is held by the housing 130 adjacent the contact module 174. The body 220 extends a length 248 between the mating edge 240 and a rear edge 250, and extends a length 252 between an outer edge 254 and the mounting edge 242. The lengths 248 and 252 are substantially similar to the lengths 208 and 212 of the other signal contact module 172.

Figure 8:
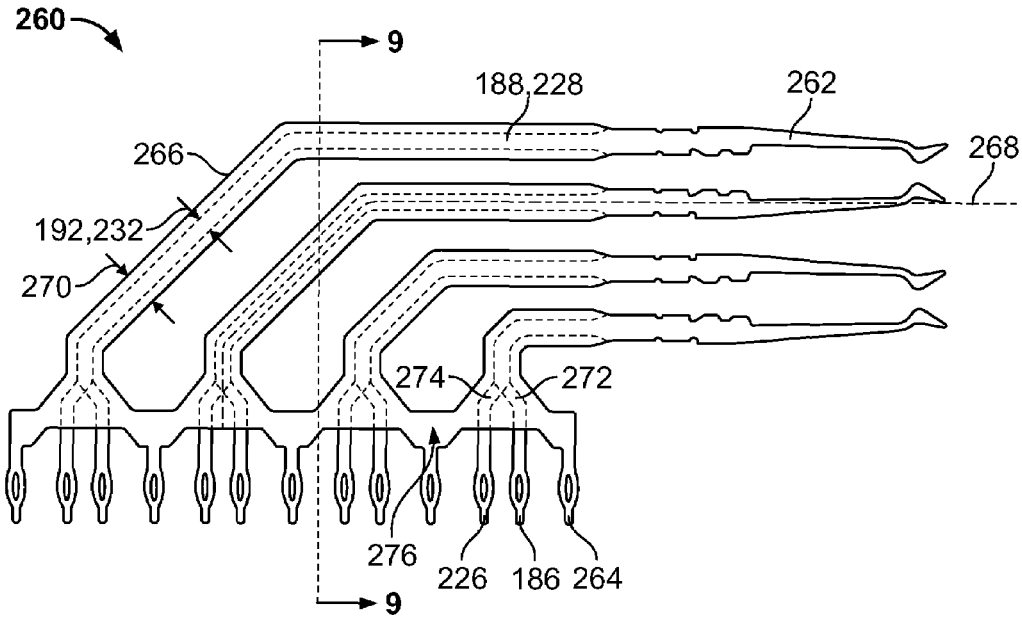
FIG. 8 illustrates a leadframe of a ground contact module for use with the receptacle connector assembly.

FIG. 8 illustrates a leadframe 260 of the ground contact module 170, with a body 261 (shown in FIG. 9) of the ground contact module removed for clarity. FIG. 8 also illustrates the leadframe 182 (shown in FIG. 6) and the leadframe 222 (shown in FIG. 7), also referred to hereinafter as signal leadframes, with portions overlapped by the ground leadframe 260 shown in phantom.

The ground leadframe 260 includes a plurality of mating contacts 262, a plurality of mounting contacts 264 and a plurality of leads 266 that electrically interconnect the mating and mounting contacts 262, 264. Optionally, the leads 266 and corresponding contacts 262, 264 are co-planar along a ground lead plane. The leads 266 extend along separate paths between corresponding mating and mounting contacts 262, 264. The paths followed by the leads 266 are substantially similar to the paths followed by the leads 188 (shown in FIG. 6) and the leads 228 (shown in FIG. 7), such that the leads 266 are generally aligned with the leads 188, 228 in a direction transverse to the ground lead plane of the ground leadframe 260. The leads 266 generally extend along a lead axis 268 that defines the path. The leads 266 have a lead length that is defined along the lead axis 268 between the mating and mounting contacts 262, 264. In the illustrated embodiment, the ground leads 266 are aligned with the signal leads 188 and 228 along substantially the entire length of the ground leads 266.

The leads 266 also have a width 270 that is defined transverse to the lead axis 268 and the length. As illustrated in FIG. 8, the widths 270 of the ground leads 266 are greater than the widths 192 of the signal leads 188 and the widths 232 of the signal leads 228. For example, the widths 270 may be approximately two or three times as wide as the widths 192 or 232.

The leads 266 have a thickness that is defined transverse to the length and the width 270. A cross-section of each lead 266 is defined by the width 270 and the thickness. Once overmolded, the leadframe 260 fills a predetermined volume of the body of the ground contact module 170. Because the ground leads 266 are wider than the signal leads 188 or 228, the ground leads 266 tend to fill a greater volume of the ground contact modules 170 as compared to the case of the signal contact modules 172 or 174.

As illustrated in FIG. 8, the signal leads 188 of the signal contact module 172 are substantially aligned with the signal leads 228 of the other signal contact module 174. However the leads 188 and 228 include transition sections 272 and 274, respectively, proximate the mounting contacts 186 and 226 that are off-set in opposite directions. As such, the mounting contacts 186 are off-set with respect to the mounting contacts 226. Such off-sets allow the mounting contacts 186 and 226 to correspond with the pin pattern and be mounted to the vias 142 in the circuit board 106 (shown in FIG. 3). Additionally, the ground mounting contacts 264 are off-set with respect to the signal mounting contacts 186, 226 such that each of the sets of signal mounting contacts 186, 226 are bounded on either side by ground mounting contacts 264. In the illustrated embodiment, while four ground leads 266 are provided, five ground mounting contacts 264 are provided. Additionally, each ground lead 266 is joined to one another by a web portion 276 proximate the mounting contacts 264. The ground mounting contacts 264 extend from the web portions 276.

Figure 9:
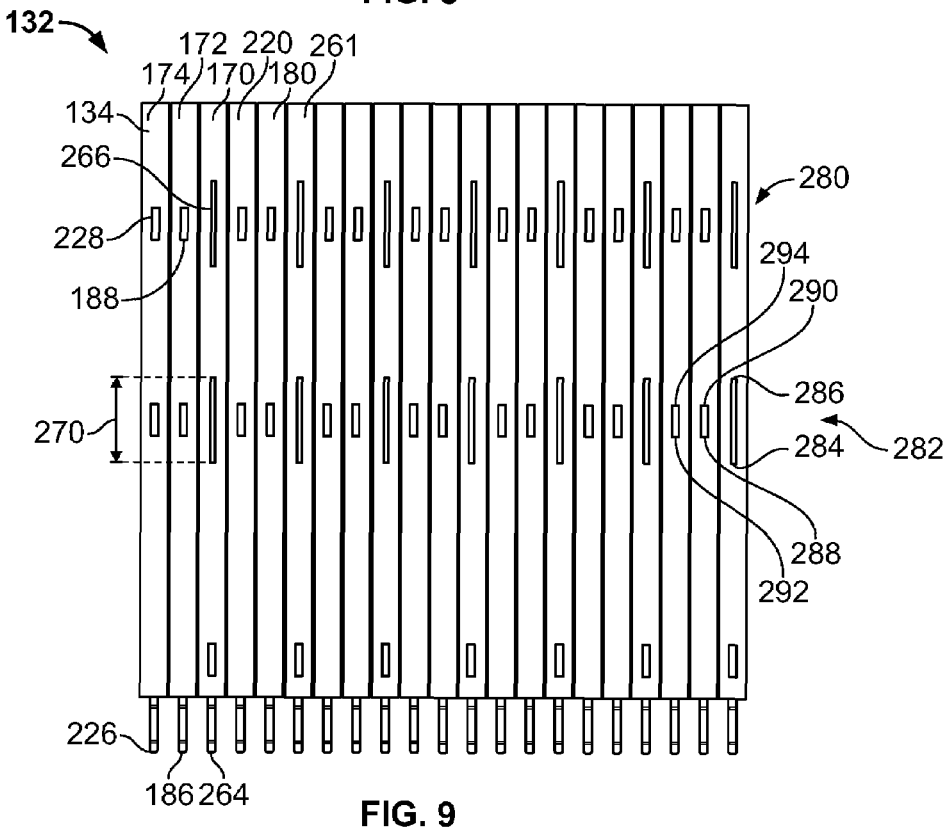
FIG. 9 is a cross-sectional view contact modules.

FIG. 9 is a cross-sectional view of the contact module assembly 132 taken along line 9-9 from FIG. 8 vertically between the middle two mounting contacts 186, 226 and off-set with respect to the ground mounting contact 264. The individual contact modules 134 are arranged in a repeating pattern of ground contact module 170, first signal contact module 172 and second signal contact module 174. FIG. 9 illustrates that each of the leads 188, 228, 266 are aligned with one another to form radial bands that are defined with respect to the imaginary corner 203 (shown in FIG. 6) at the intersection of the mating and mounting edges of the bodies 180, 220, 261. For example, a radial outer band 280 is illustrated in FIG. 9. A second radial band 282 is illustrated as inward (e.g. toward the mating edge and/or the mounting edge) with respect to the radially outer band 280. In the embodiment illustrated in the Figures, two additional radial bands (not shown in FIG. 9) are included radially inward of the second radial band 282.

Each of the ground leads 266 include an inner edge 284 and an outer edge 286. Similarly, each of the signal leads 188 of the first contact modules 172 include an inner edge 288 and an outer edge 290. Each of the signal leads 228 of the second contact modules 174 include an inner edge 292 and an outer edge 294. Optionally, the inner edges 288, 292 of the signal leads 188, 228, respectively, are substantially aligned with one another. Additionally, the outer edges 290, 294 of the signal leads 188, 228, respectively, are substantially aligned with one another. However, because the widths 270 of the ground leads 266 are wider than the signal leads 188, 228, the inner edges 284 of the ground leads 266 are positioned radially inward with respect to the inner edges 288, 292. Additionally, the outer edges 290 of the ground leads 266 are positioned radially outward with respect to the outer edges 290, 294. The enlarged, or widened, ground leads 266 provide additional protection or compensation to the receptacle connector 120 (shown in FIG. 2) to enhance the electrical performance of the receptacle connector 120. For example, the ground leads 266 provide a larger buffer between adjacent signal pairs, as compared to when a ground lead having a similar width as the signal leads is used, thus reducing crosstalk therebetween.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A connector assembly comprising:

a housing; and a contact module assembly including first and second contact modules loaded into the housing, the first contact module having a plurality of ground leads extending between mating contacts and mounting contacts, the ground leads extending along separate paths within a first plane, the second contact module having a plurality of signal leads extending between mating contacts and mounting contacts, the signal leads extending along separate paths within a second plane, the ground leads being aligned with the signal leads in a direction transverse to the first plane, wherein the ground leads have a width and a thickness defining a cross-sectional area that is larger than a cross sectional area of the signal leads.

2. The connector assembly of claim 1, wherein the ground leads are wider than the signal leads.

3. The connector assembly of claim 1, wherein a lead axis of the ground leads are substantially aligned with a lead axis of corresponding signal leads.

4. The connector assembly of claim 1, wherein the paths are non-linear and extend between mating contacts and mounting contacts that are generally perpendicular to one another.

5. The connector assembly of claim 1, wherein the first and second contact modules each include a dielectric body and a leadframe, the bodies of the first and second contact modules are substantially similarly dimensioned, wherein the leads of the leadframes of the first and second contact modules are sized differently.

6. The connector assembly of claim 1, further comprising a third contact module loaded into the housing, the third contact module having a plurality of signal leads corresponding to signal leads of the second contact module to define differential signal pairs.

7. The connector assembly of claim 6, wherein the contact module assembly includes a plurality of first contact modules, a plurality of second contact modules and a plurality of third contact modules, the contact modules being loaded into the housing in a pattern having second and third contact modules arranged adjacent one another and forming signal module pairs, and wherein at least one first contact module is arranged between adjacent signal module pairs.

8. The connector assembly of claim 1, wherein the ground leads and the signal leads are aligned along substantially an entire length of the respective paths.

9. The connector assembly of claim 1, wherein the first contact module includes a first body encasing the ground leads, the ground leads filling a predetermined volume of the first body, the second contact module includes a second body that is dimensioned the same as the first body and encases the signal leads, the signal leads filling a predetermined volume of the second body that is a lesser volume than that filled by the ground leads of the first contact module.

10. A contact module assembly comprising:

a first contact module having a plurality of ground leads extending between mating contacts and mounting contacts, the ground leads extending along separate paths within a first plane, the ground leads having a width and a length defined within the first plane;

a second contact module adjacent the first contact module and having a plurality of signal leads extending between mating contacts and mounting contacts, the signal leads extending along separate paths within a second plane, the signal leads having a width and a length defined within the second plane; and a third contact module adjacent the second contact module and having a plurality of signal leads extending between mating contacts and mounting contacts, the signal leads extending along separate paths within a third plane, the signal leads having a width and a length defined within the third plane;

wherein the ground leads are aligned with the signal leads of both the second contact module and the third contact module in a direction transverse to the first plane and wherein the ground leads are wider than the signal leads.

11. The contact module assembly of claim 10, wherein each of the contact modules includes a mating edge and a mounting edge arranged orthogonally with one another, an imaginary corner being defined at the intersection of the mating edge and the mounting edge, wherein the ground leads and the signal leads are arranged in radial bands defined with respect to the imaginary corner, each band including a single ground lead, a single signal lead from the second contact module and a single signal lead from the third contact module.

12. The contact module assembly of claim 11, wherein the ground leads are aligned with respect to the signal leads such that, for each band, an outer edge of the ground lead is positioned radially outward with respect to an outer edge of each signal lead.

13. The contact module assembly of claim 11, wherein the ground leads are aligned with respect to the signal leads such that, for each band, an inner edge of the ground lead is positioned radially inward with respect to an inner edge of each signal lead.

14. The contact module assembly of claim 10, wherein an equal number of ground leads are provided in the first contact module as signal leads in the second contact module and as signal leads in the third contact module.

15. The contact module assembly of claim 10, wherein the first contact module includes N-number of mating contacts and N+1-number of mounting contacts.

16. A connector assembly comprising:

a housing;

a plurality of signal contact modules arranged as signal module pairs, each signal contact module including a body, a radially inner signal lead and a radially outer signal lead separate from the radially inner signal lead, the radially inner signal leads being defined by inner and outer edges and the radially outer signal leads being defined by inner and outer edges, the radially outer signal leads within each signal module pair cooperating to define a first differential pair, the radially inner signal leads within each signal module pair cooperating to define a second differential pair; and a plurality of ground contact modules arranged within the housing such that the ground contact modules bound opposite sides of the signal contact modules of at least one of the signal module pairs, the ground contact modules including a body, a radially inner ground lead and a radially outer ground lead, the radially inner ground leads being defined by inner and outer edges and the radially outer ground leads being defined by inner and outer edges;

wherein the ground leads are wider than the signal leads such that the outer edges of the ground leads are positioned radially outward with respect to the outer edges of the signal leads, and such that the inner edges of the ground leads are positioned radially inward with respect to the inner edges of the signal leads.

17. The connector assembly of claim 16, wherein each of the contact modules includes a mating edge and a mounting edge arranged orthogonally with one another, an imaginary corner being defined at the intersection of the mating edge and the mounting edge, wherein the radial direction is generally defined with respect to the imaginary corner.

18. The connector assembly of claim 16, wherein the radial direction of each signal lead is taken transverse to a signal lead axis taken along a length of the signal lead, and wherein the radial direction of each ground lead is taken transverse to a ground lead axis taken along a length of the ground lead.

19. The connector assembly of claim 16, wherein the inner and outer edges of the radially outer signal leads are aligned with one another, and wherein the inner and outer edges of the radially inner signal leads are aligned with one another.

20. The connector assembly of claim 16, further comprising at least two signal module pairs, a first of the ground contact modules being positioned between the signal module pairs, the signal module pairs being arranged within the housing such that first differential pairs in a first signal module pair are aligned with first differential pairs in a second signal module pair in a direction transverse to the bodies of the signal contact modules and second differential pairs in a first signal module pair are aligned with second differential pairs in a second signal module pair in a direction transverse to the bodies of the signal contact modules, and ground leads are positioned between the aligned first differential pairs and between the aligned second differential pairs.

* * * * *